US005990847A

United States Patent [19]

Filipovic et al.

[11] Patent Number: 5,990,847

[45] **Date of Patent: *Nov. 23, 1999**

[54] COUPLED MULTI-SEGMENT HELICAL ANTENNA

[75] Inventors: Daniel Filipovic; Ali Tassoudji, both of San Diego, Calif.

[73] Assignee: Qualcomm Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/640,298

[22] Filed: Apr. 30, 1996

[51] Int. Cl.[6] ..... H01Q 1/36; H01Q 1/24

[52] U.S. Cl. ..... 343/895; 343/702

[58] Field of Search ..... 343/895, 702, 343/850, 908, 796, 853

[56] References Cited

U.S. PATENT DOCUMENTS

| | | | |
|---|---|---|---|
| 3,369,243 | 2/1968 | Greiser | 343/770 |
| 4,008,479 | 2/1977 | Smith | 343/895 |
| 4,148,030 | 4/1979 | Foldes | 343/895 |
| 4,349,824 | 9/1982 | Harris | 343/700 MS |
| 4,400,702 | 8/1983 | Tanaka | 343/790 |
| 4,658,262 | 4/1987 | DuHamel | 343/792.5 |
| 4,725,845 | 2/1988 | Phillips | 343/702 |
| 5,134,422 | 7/1992 | Auriol | 343/895 |
| 5,198,831 | 3/1993 | Burrell et al. | 343/895 |
| 5,223,849 | 6/1993 | Kasevich et al. | 343/895 |
| 5,255,005 | 10/1993 | Terret et al. | 343/895 |
| 5,298,910 | 3/1994 | Takei et al. | 343/895 |
| 5,346,300 | 9/1994 | Yamamoto et al. | 343/895 |
| 5,349,365 | 9/1994 | Ow et al. | 343/895 |
| 5,359,340 | 10/1994 | Yokota | 343/792 |
| 5,450,093 | 9/1995 | Kim | 343/895 |
| 5,479,180 | 12/1995 | Lenzing et al. | 343/729 |
| 5,485,170 | 1/1996 | McCarrick | 343/895 |
| 5,541,617 | 7/1996 | Connolly et al. | 343/895 |
| 5,559,524 | 9/1996 | Takei et al. | 343/895 |
| 5,581,268 | 12/1996 | Hirshfield | 343/853 |
| 5,600,341 | 2/1997 | Thill et al. | 343/895 |
| 5,604,972 | 2/1997 | McCarrick | 343/895 |
| 5,612,707 | 3/1997 | Vaughan et al. | 343/895 |
| 5,828,348 | 10/1998 | Tassoudji et al. | 343/895 |

FOREIGN PATENT DOCUMENTS

| | | | |
|---|---|---|---|
| 0320404 | 6/1989 | European Pat. Off. | H01Q 11/08 |
| 0715369 | 6/1996 | European Pat. Off. | H01Q 11/08 |
| 0757406 | 2/1997 | European Pat. Off. | H01Q 11/08 |
| 0905513 | 11/1997 | European Pat. Off. | H01Q 11/08 |
| 03236612 | 10/1991 | Japan | H01Q 9/27 |
| 9711507 | 3/1997 | WIPO | H01Q 11/08 |
| 9741695 | 11/1997 | WIPO . | |
| 9805087 | 2/1998 | WIPO | H01Q 1/36 |

OTHER PUBLICATIONS

Jalil Rashed et al., "A New Class of Resonant Antennas", *IEEE Transactions on Antennas and Propagation*, vol. 39, No. 9, Sep. 9, 1991, pp. 1428–1430.

Kraus, John D., "Antennas", Second Edition, McGraw–Hill, Inc., New York, 1988, Chapter 7 and Section 11–9.

*Primary Examiner*—Hoanganh Le

*Attorney, Agent, or Firm*—Russell B. Miller; Gregory D. Ogrod

[57] ABSTRACT

A coupled multi-segment helical antenna is provided having a length that is shorter than otherwise obtainable for a conventional half-wavelength antenna. The coupled multi-segment helical antenna includes radiator portion having a plurality of helically wound radiators extending from one end of the radiator portion to the other end of the radiator portion. Each radiator is made up of a set of two or more segments. A first segment extends in a helical fashion from the first end of the radiator portion toward the second end of the radiator portion. The second segment extends in a helical fashion from the second end of the radiator portion toward the first end of the radiator portion, wherein a portion of the first radiator segment is in proximity with a portion of the second radiator segment such that the first and second radiator segments are electromagnetically coupled to one another.

29 Claims, 13 Drawing Sheets

COUPLED MULTI-SEGMENT HELICAL ANTENNA

BACKGROUND OF THE INVENTION

I. Field of the Invention

This invention relates generally to helical antennas and more specifically to a helical antenna having coupled radiator segments.

II. Field of the Invention

Contemporary personal communication devices are enjoying widespread use in numerous mobile and portable applications. With traditional mobile applications, the desire to minimize the size of the communication device, such as a mobile telephone for example, led to a moderate level of downsizing. However, as the portable, hand-held applications increase in popularity, the demand for smaller and smaller devices increases dramatically. Recent developments in processor technology, battery technology and communications technology have enabled the size and weight of the portable device to be reduced drastically over the past several years.

One area in which reductions in size are desired is the devices antenna. The size and weight of the antenna play an important role in downsizing the communication device. The overall size of the antenna can impact the size of the device's body. Smaller diameter and shorter length antennas can allow smaller overall device sizes as well as smaller body sizes.

Size of the device is not the only factor that needs to be considered in designing antennas for portable applications. Another factor to be considered in designing antennas is attenuation and/or blockage effects resulting from the proximity of the user's head to the antenna during normal operations. Yet another factor is the characteristics of the communication link, such as, for example, desired radiation patterns and operating frequencies.

An antenna that finds widespread usage in satellite communication systems is the helical antenna. One reason for the helical antenna's popularity in satellite communication systems is its ability to produce and receive circularly-polarized radiation employed in such systems. Additionally, because the helical antenna is capable of producing a radiation pattern that is nearly hemispherical, the helical antenna is particularly well suited to applications in mobile satellite communication systems and in satellite navigational systems.

Conventional helical antennas are made by twisting the radiators of the antenna into a helical structure. A common helical antenna is the quadrifilar helical antenna which utilizes four radiators spaced equally around a core and excited in phase quadrature (i.e., the radiators are excited by signals that differ in phase by one-quarter of a period or 90°). The length of the radiators is typically an integer multiple of a quarter-wavelength of the operating frequency of the communication device. The radiation patterns are typically adjusted by varying the pitch of the radiator, the length of the radiator (in integer multiples of a quarter-wavelength), and the diameter of the core.

Conventional helical antennas can be made using wire or strip technology. With strip technology, the radiators of the antenna are etched or deposited onto a thin, flexible substrate. The radiators are positioned such that they are parallel to each other, but at an obtuse angle to one or more edges of the substrate. The substrate is then formed, or rolled, into a cylindrical, conical, or other appropriate shape causing the strip radiators to form a helix.

This conventional helical antenna, however, also has the characteristic that the radiator lengths are an integer multiple of one-quarter wavelength of the desired resonant frequency, resulting in an overall antenna length that is longer than desired for some portable or mobile applications.

SUMMARY OF THE INVENTION

The present invention is directed toward a helical antenna having one or more helically wound radiators. The radiators are wound such that the antenna is in a cylindrical, conical, or other appropriate shape to optimize radiation patterns. According to the invention, each radiator is comprised of a set of two or more radiator segments. Each segment in the set is physically separate from but electromagnetically coupled to the other segment(s) in the set. The length of the segments in the set is chosen such that the set (i.e., the radiator) resonates at a particular frequency. Because the segments in a set are physically separate but electromagnetically coupled to one another, the length at which the radiator resonates for a given frequency can be made shorter than that of a conventional helical antenna radiator.

Therefore, an advantage of the invention is that for a given operating frequency, the radiator portion of the coupled multi-segment helical antenna can be made to resonate at a shorter total radiator length and/or in a smaller volume than a conventional helical antenna with the same effective resonant length.

Another advantage of the coupled multi-segment helical antenna is that it can be easily tuned to a given frequency by adjusting or trimming the length of the radiator segments. Because the radiators are not a single contiguous length, but instead are made up of a set of two or more overlapping segments, the length of the segments can easily be modified after the antenna has been made to properly tune the frequency of the antenna by trimming the radiators. Additionally, the overall radiation pattern of the antenna is essentially unchanged by the tuning because the overall physical length of the radiator portion of the antenna is unchanged by the trimming.

Yet another advantage of the invention is that its directional characteristics can be adjusted to maximize signal strength in a preferred direction, such as along the axis of the antenna. Thus, for certain applications, such as satellite communications for example, the directional characteristics of the antenna can be optimized to maximize signal strength in the upward direction, away from the ground.

Further features and advantages of the present invention, as well as the structure and operation of various embodiments of the present invention, are described in detail below with reference to the accompanying drawings.

BRIEF DESCRIPTION OF THE DRAWINGS

The features, objects, and advantages of the present invention will become more apparent from the detailed description set forth below when taken in conjunction with the drawings in which like reference characters identify correspondingly throughout, the left-most digit(s) of a reference number identifies the drawing in which the reference number first appears, and wherein.

DETAILED DESCRIPTION OF THE PREFERRED EMBODIMENTS

1. Overview and Discussion of the Invention

The present invention is directed toward a helical antenna having coupled multi-segment radiators to shorten the length of the radiators for a given resonant frequency, thereby reducing the overall length of the antenna. The manner in which this is accomplished is described in detail below according to several embodiments.

2. Example Environment

In the broadest sense, the invention can be implemented in any system for which helical antenna technology can be utilized. One example of such an environment is a communication system in which users having fixed, mobile and/or portable telephones communicate with other parties through a satellite communication link. In this example environment, the telephone is required to have an antenna tuned to the frequency of the satellite communication link.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments.

3. Conventional Helical Antennas

Figure 1A:
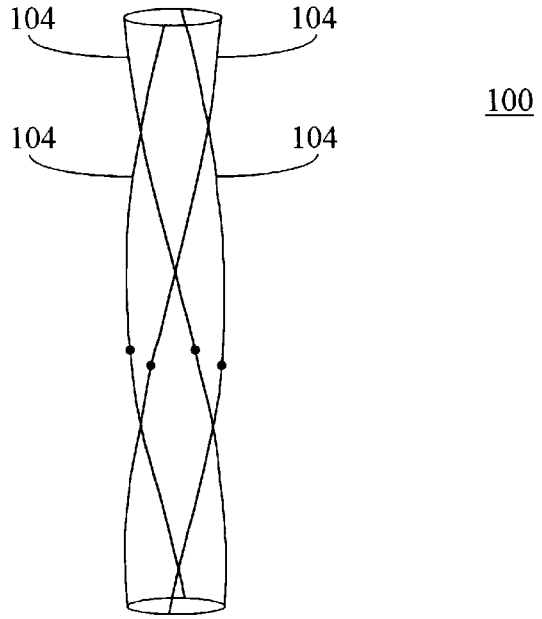
PRIOR ART FIG. 1A
FIG. 1A is a diagram illustrating a conventional wire quadrifilar helical antenna.
Figure 1B:
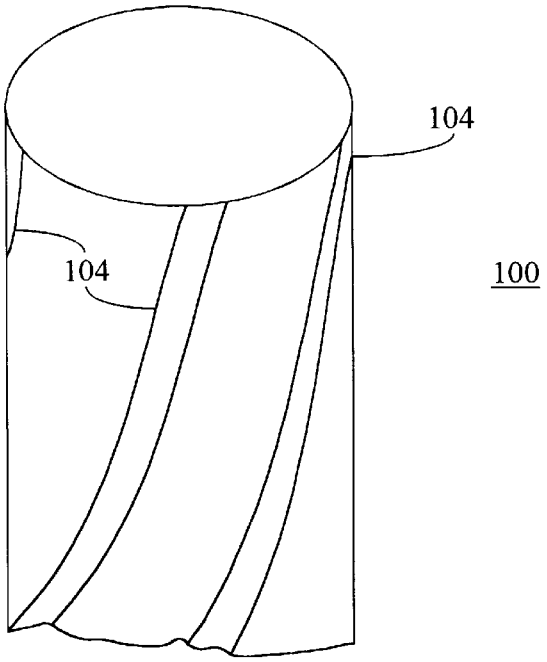
PRIOR ART FIG. 1B
FIG. 1B is a diagram illustrating a conventional strip quadrifilar helical antenna.
Figure 1C:
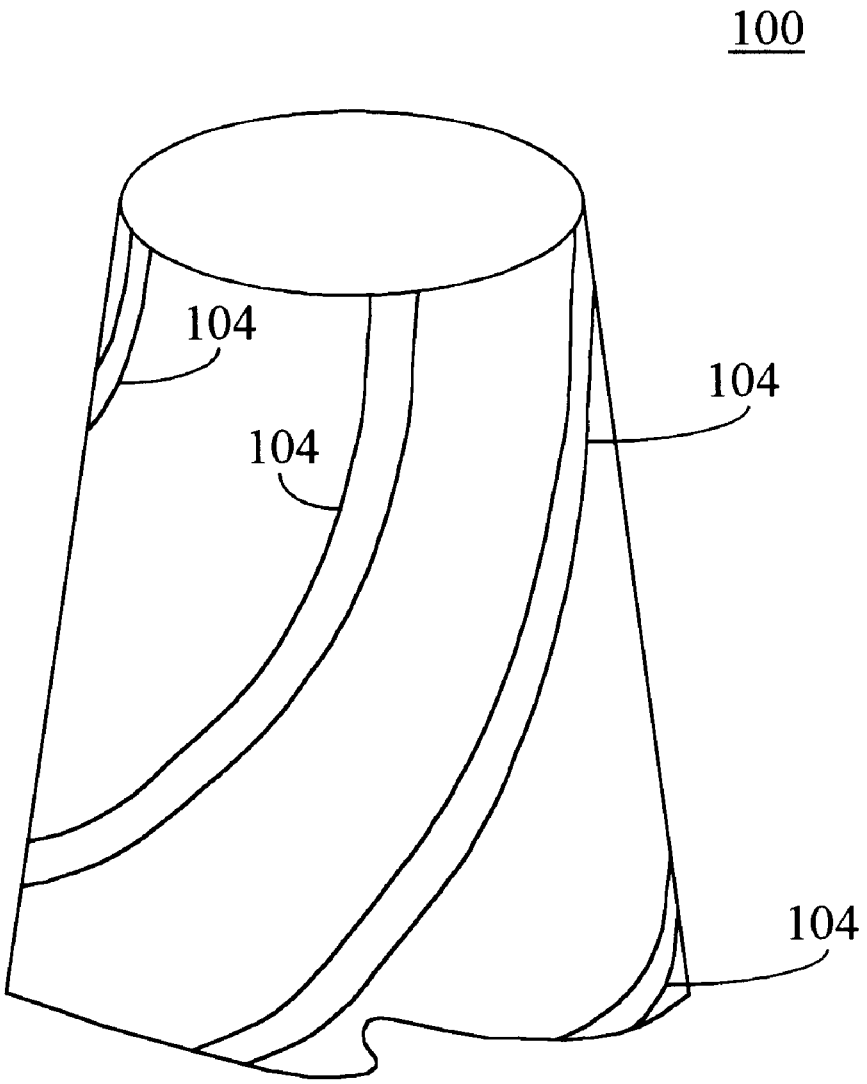
FIG. 1C is a diagram illustrating a tapered strip quadrifilar helical antenna.

Before describing the invention in detail, it is useful to describe the radiator portions of some conventional helical antennas. Specifically, this section of the document describes radiator portions of some conventional quadrifilar helical antennas. FIGS. 1A and 1B are diagrams illustrating a radiator portion 100 of a conventional quadrifilar helical antenna in wire form and in strip form, respectively. The radiator portion 100 illustrated in FIGS. 1A and 1B is that of a quadrifilar helical antenna, meaning it has four radiators 104 operating in phase quadrature. As illustrated in FIGS. 1A and 1B, radiators 104 are wound to provide circular polarization.

Figure 2A:
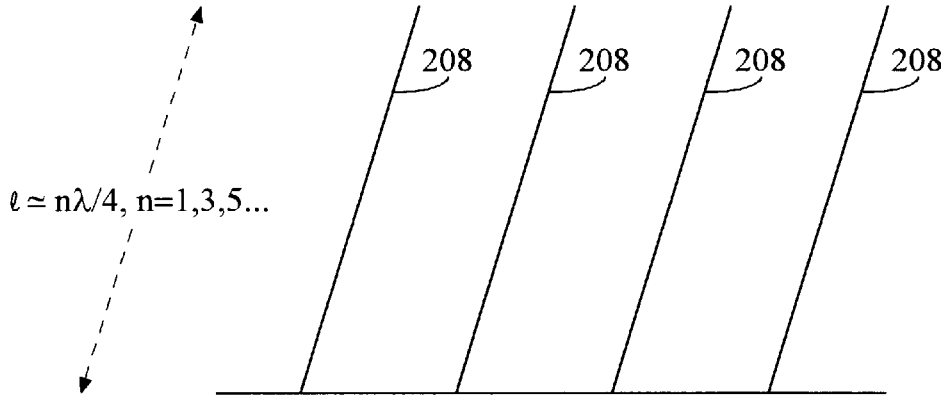
FIG. 2A is a diagram illustrating a planar representation of an open termination quadrifilar helical antenna.
Figure 2B:
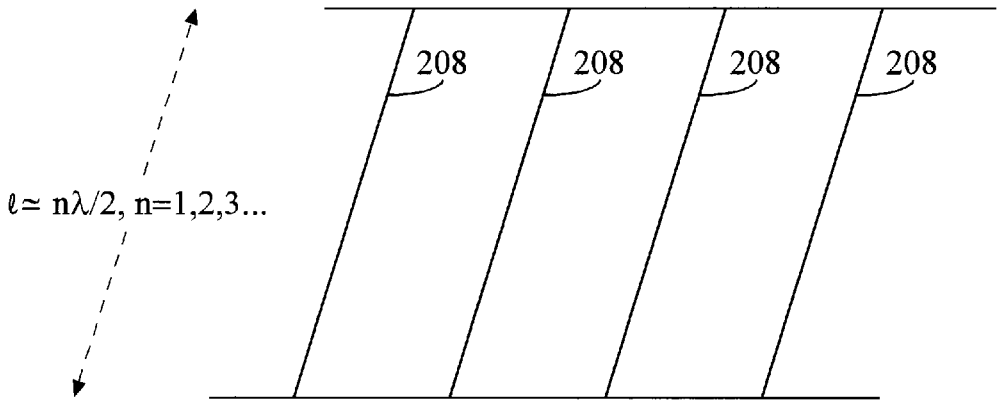
FIG. 2B is a diagram illustrating a planar representation of a shorted termination quadrifilar helical antenna.

FIGS. 2A and 2B are diagrams illustrating planar representations of a radiator portion of conventional quadrifilar helical antennas. In other words, FIGS. 2A and 2B illustrate the radiators as they would appear if the antenna cylinder were "unrolled" on a flat surface. FIG. 2A is a diagram illustrating a quadrifilar helical antenna in which the radiators are open or not connected together at the far end. For such a configuration, the resonant length l of radiators 208 is an odd integer multiple of a quarter-wavelength of the desired resonant frequency.

FIG. 2B is a diagram illustrating a quadrifilar helical antenna in which the radiators are shorted, interconnected, or connected together at the far end. In this case the resonant length l of radiators 208 is an even integer multiple of a quarter-wavelength of the desired resonant frequency. Note that in both cases, the stated resonant length l is approximate, because a small adjustment is usually needed to compensate for non-ideal short and open terminations.

Figure 3:
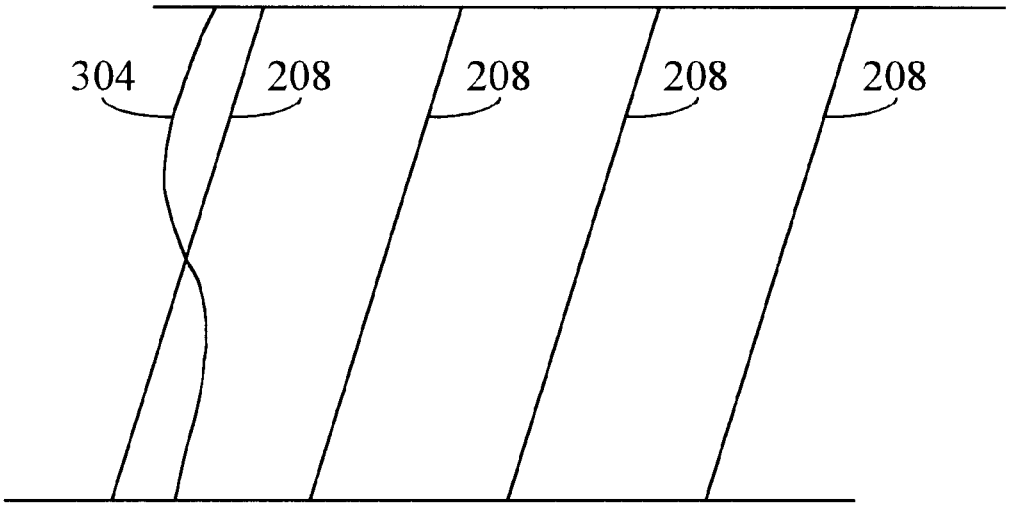
FIG. 3 is a diagram illustrating current distribution on a radiator of a shorted quadrifilar helical antenna.

FIG. 3 is a diagram illustrating a planar representation of a radiator portion of a quadrifilar helical antenna 300, which includes radiators 208 having a length $l=\lambda/2$, where $\lambda$ is the wavelength of the desired resonant frequency of the antenna. Curve 304 represents the relative magnitude of current for a signal on a radiator 208 that resonates at a frequency of $f=v/\lambda$, where $v$ is the velocity of the signal in the radiator medium.

Example implementations of a quadrifilar helical antenna implemented using printed circuit board techniques (a strip antenna) are described in more detail with reference to FIGS. 4–6. The strip quadrifilar helical antenna is comprised of strip radiators 104 etched onto a dielectric substrate 406. The substrate is a thin flexible material that is rolled into a cylindrical shape such that radiators 104 are helically wound about a central axis of the cylinder.

Figures 4, 5:
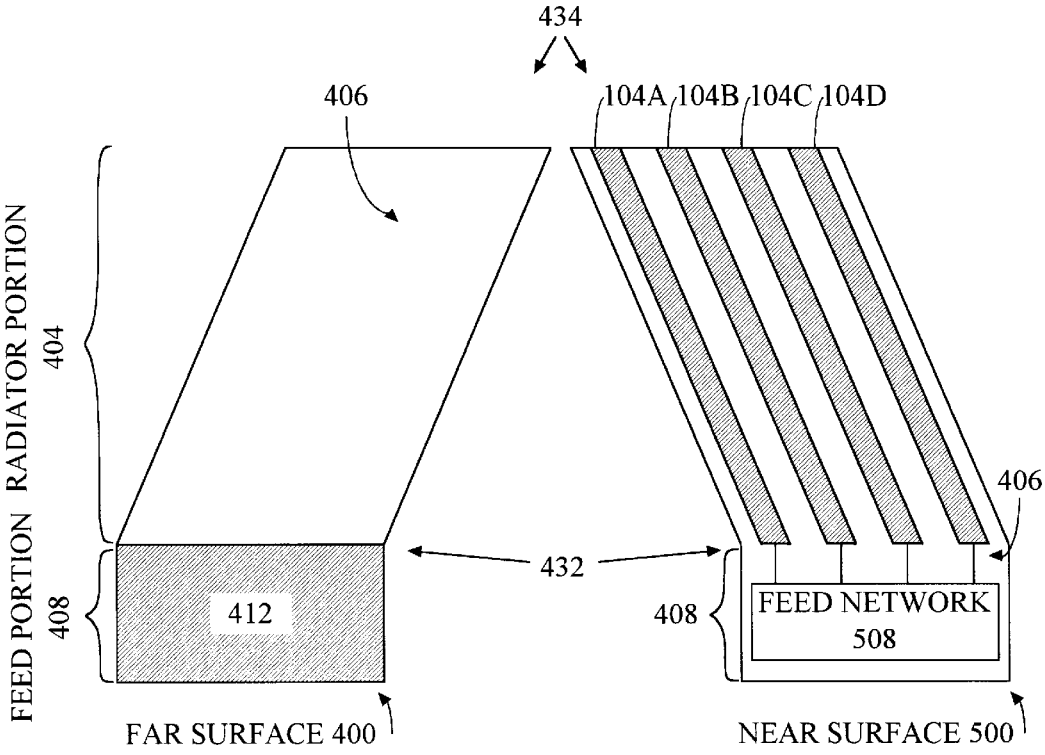
FIG. 4 is a diagram illustrating a far surface of an etched substrate of a strip helical antenna.
FIG. 5 is a diagram illustrating a near surface of an etched substrate of a strip helical antenna.
Figure 6:
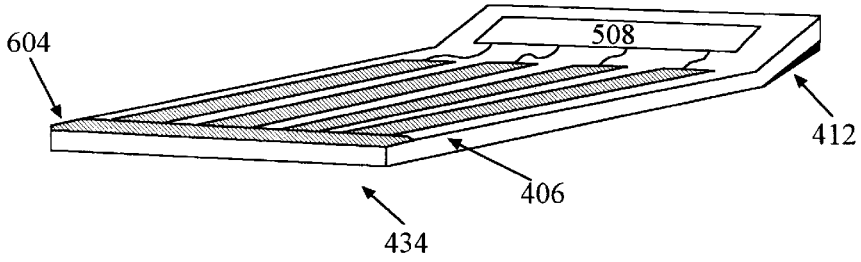
FIG. 6 is a diagram illustrating a perspective view of an etched substrate of a strip helical antenna.

FIGS. 4–6 illustrate the components used to fabricate a quadrifilar helical antenna 100. FIGS. 4 and 5 present a view of a far surface 400 and near surface 500 of substrate 406, respectively. The antenna 100 includes a radiator portion 404, and a feed portion 408.

In the embodiments described and illustrated herein, the antennas are described as being made by forming the substrate into a cylindrical shape with the near surface being on the outer surface of the formed cylinder. In alternative embodiments, the substrate is formed into the cylindrical shape with the far surface being on the outer surface of the cylinder.

In one embodiment, dielectric substrate 100 is a thin, flexible layer of polytetraflouroethalene (PTFE), a PTFE/glass composite, or other dielectric material. In one embodiment, substrate 406 is on the order of 0.005 in., or 0.13 mm thick, although other thicknesses can be chosen. Signal traces and ground traces are provided using copper. In alternative embodiments, other conducting materials can be chosen in place of copper depending on cost, environmental considerations and other factors.

In the embodiment illustrated in FIG. 5, feed network 508 is etched onto feed portion 408 to provide the quadrature phase signals (i.e., the 0°, 90°, 180° and 270° signals) that are provided to radiators 104 (104A–D). Feed portion 408 of far surface 400 provides a ground plane 412 for feed circuit 508. Signal traces for feed circuit 508 are etched onto near surface 500 of feed portion 408.

For purposes of discussion, radiator portion 404 has a first end 432 adjacent to feed portion 408 and a second end 434 (on the opposite end of radiator portion 404). Depending on the antenna embodiment implemented, radiators 104 can be etched into far surface 400 of radiator portion 404. The length at which radiators 104 extend from first end 432 toward second end 434 is approximately an integer multiple of a quarter-wavelength of the desired resonant frequency.

In such an embodiment where radiators 104 are an integer multiple of $\lambda/2$ in length, radiators 104 are electrically connected to each other (i.e., shorted or short circuited) at second end 434. This connection can be made by a conductor across second end 434 which forms a ring 604 around the circumference of the antenna when the substrate is formed into a cylinder. FIG. 6 is a diagram illustrating a perspective view of an etched substrate of a strip helical antenna having a shorting ring 604 at second end 434.

One conventional quadrifilar helical antenna is described in U.S. Pat. No. 5,198,831 to Burrell, et. al. (referred to as the 831 patent), which is incorporated herein by reference. The antenna described in the 831 patent is a printed circuit-board antenna having the antenna radiators etched or otherwise deposited on a dielectric substrate. The substrate is formed into a cylinder resulting in a helical configuration of the radiators.

Another conventional quadrifilar helical antenna is disclosed in U.S. Pat. No. 5,255,005 to Terret et al (referred to as the 005 patent) which is incorporated herein by reference. The antenna described in the 005 patent is a quadrifilar helical antenna formed by two bifilar helices positioned orthogonally and excited in phase quadrature. The disclosed antenna also has a second quadrifilar helix that is coaxial and electromagnetically coupled with the first helix to improve the passband of the antenna.

Yet another conventional quadrifilar helical antenna is disclosed in U.S. Pat. No. 5,349,365, to Ow et al (referred to as the 365 patent) which is incorporated herein by reference. The antenna described in the 365 patent is a quadrifilar helical antenna designed in wireform as described above with reference to FIG. 1A.

4. Coupled Multi-Segment Helical Antenna Embodiments

Having thus briefly described various forms of a conventional helical antenna, a coupled multi-segment helical antenna according to the invention is now described in terms of several embodiments. In order to reduce the length of radiator portion 100 of the antenna, the invention utilizes coupled multi-segment radiators that allow for resonance at a given frequency at shorter lengths than would otherwise be needed for a conventional helical antenna with an equivalent resonant length.

Figure 7A:
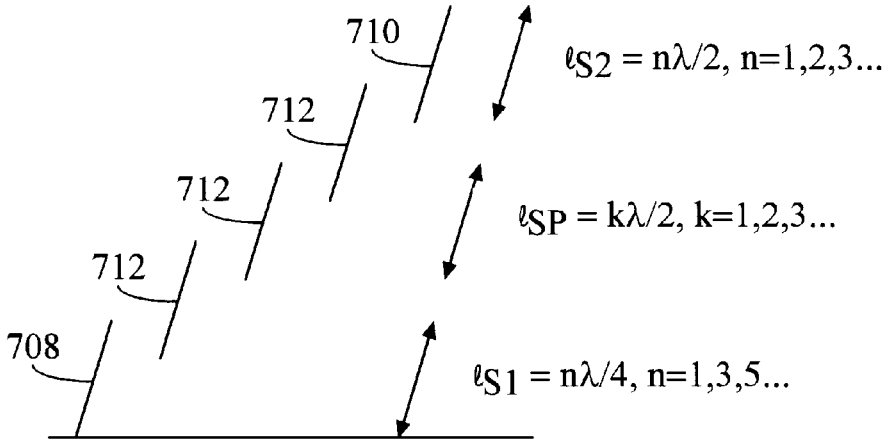
FIG. 7A is a diagram illustrating an open coupled multi-segment radiator having five coupled segments according to one embodiment of the invention.
Figure 7B:
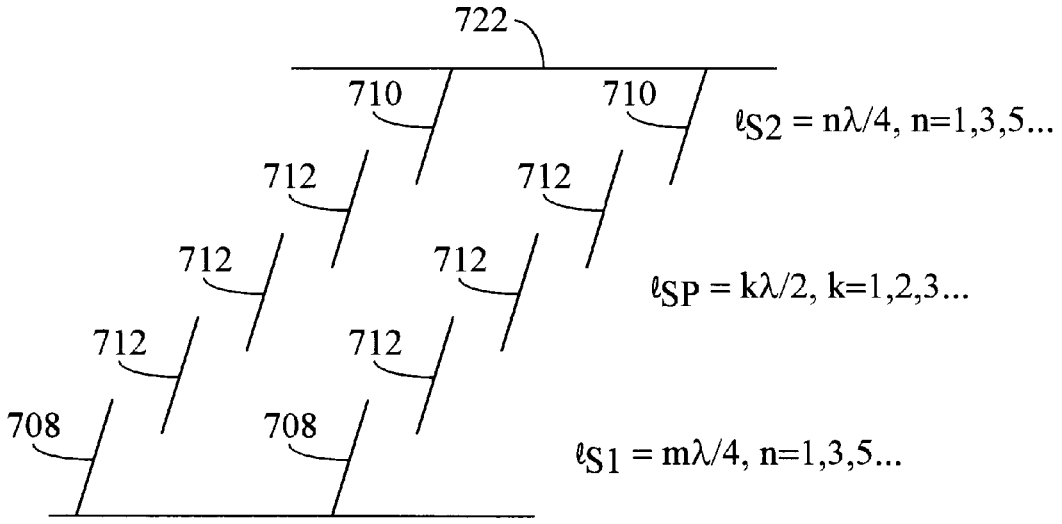
FIG. 7B is a diagram illustrating a pair of shorted coupled multi-segment radiators according to one embodiment of the invention.

FIGS. 7A and 7B are diagrams illustrating planar representations of example embodiments of coupled-segment helical antennas. FIG. 7A illustrates a coupled multi-segment radiator 706 terminated in an open-circuit (not shorted together) according to one single-filar embodiment. An antenna terminated in an open-circuit such as this may be used in a single-filar, bifilar, quadrifilar, or other x-filar implementation.

The embodiment illustrated in FIG. 7A is comprised of a single radiator 706. Radiator 706 is comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the open termination embodiment, the length $l_{s1}$ of segment 708 is an odd-integer multiple of one-quarter wavelength of the desired resonant frequency. The length $l_{s2}$ of segment 710 is an integer multiple of one-half the wavelength of the desired resonant frequency. The length $l_p$ of each of the p intermediate segments 712 is an integer multiple of one-half the wavelength of the desired resonant frequency. In the illustrated embodiment, there are three intermediate segments 712 (i.e., p=3).

FIG. 7B illustrates radiators 706 of the helical antenna when terminated in a short or connector 722. This shorted implementation is not suitable for a single-filar antenna, but can be used for bifilar, quadrifilar or other x-filar antennas. As with the open termination embodiment, radiators 706 are comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the shorted embodiment, the length $l_{s1}$ of segment 708 is an odd-integer multiple of one-quarter wavelength of the desired resonant frequency. The length $l_{s2}$ of segment 710 is an odd-integer multiple of one-quarter wavelength of the desired resonant frequency. The length $l_p$ of each of the p intermediate segments 712 is an integer multiple of one-half the wavelength of the desired resonant frequency. In the illustrated embodiment, there are three intermediate segments 712 (i.e., p=3).

Figure 8A:
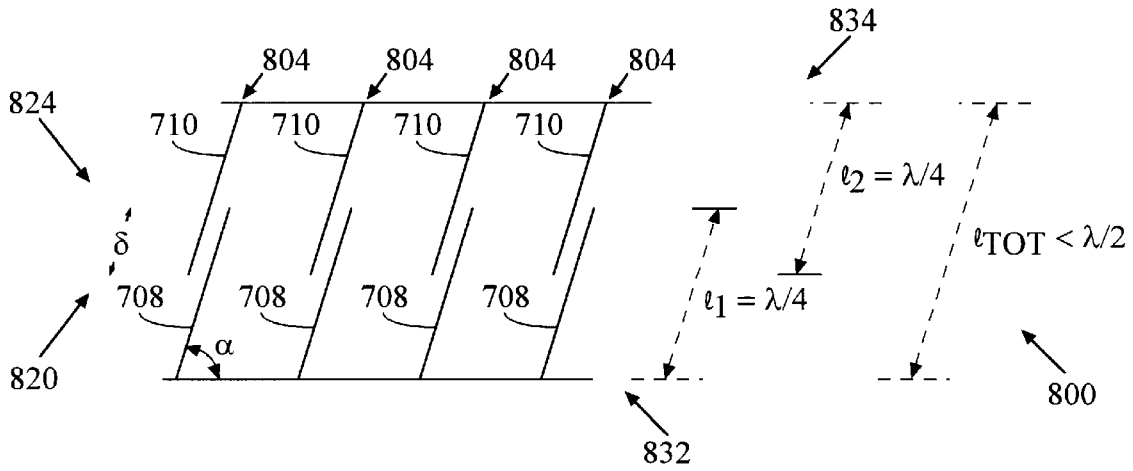
FIG. 8A is a diagram illustrating a planar representation of a shorted coupled multi-segment quadrifilar helical antenna according to one embodiment of the invention.
Figure 8B:
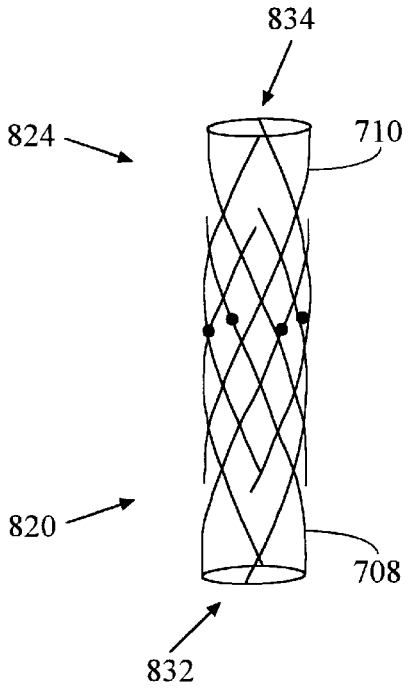
FIG. 8B is a diagram illustrating a coupled multi-segment quadrifilar helical antenna formed into a cylindrical shape according to one embodiment of the invention.

FIGS. 8A and 8B are diagrams illustrating a coupled multi-segment quadrifilar helical antenna radiator portion 800 according to one embodiment of the invention. FIGS. 8A and 8B illustrate one example implementation of the antenna illustrated in FIG. 7B, where p=zero (i.e., there are no intermediate segments 712) and the lengths of segments 708, 710 are one-quarter wavelength.

The radiator portion 800 illustrated in FIG. 8A is a planar representation of a quadrifilar helical antenna, having four coupled radiators 804. Each coupled radiator 804 in the coupled antenna is actually comprised of two radiator segments 708, 710 positioned in close proximity with one another such that the energy in radiator segment 708 is coupled to the other radiator segment 710.

More specifically, according to one embodiment, radiator portion 800 can be described in terms of having two sections 820, 824. Section 820 is comprised of a plurality of radiator segments 708 extending from a first end 832 of the radiator portion 800 toward the second end 834 of radiator portion 800. Section 824 is comprised of a second plurality of radiator segments 710 extending from second end 834 of the radiator portion 800 toward first end 832. Toward the center area of radiator portion 800, a part of each segment 708 is in close proximity to an adjacent segment 710 such that energy from one segment is coupled into the adjacent segment in the area of proximity. This relative proximity is referred to in this document as overlap.

In a preferred embodiment, each segment 708, 710 is of a length of approximately $l_1=l_2=\lambda/4$. The overall length of a single radiator comprising two segments 708, 710 is defined as $l_{tot}$. The amount one segment 708 overlaps another segment 710 is defined as $\delta=l_1+l_2-l_{tot}$.

For a resonant frequency $f=v/\lambda$ the overall length of a radiator $l_{tot}$ is less than the half-wavelength length of $\lambda/2$. In other words, as a result of coupling, a radiator, comprising a pair of coupled segments 708, 710, resonates at frequency $f=v/\lambda$ even though the overall length of that radiator is less than a length of $\lambda/2$. Therefore, radiator portion 800 of a half-wavelength coupled multi-segment quadrifilar helical antenna is shorter than the radiator portion of conventional half-wavelength quadrifilar helical antenna 800 for a given frequency $f$.

For a clearer illustration of the reduction in size gained by using the coupled configuration, compare the radiator portions 800 illustrated in FIG. 8 with those illustrated in FIG. 3. For a given frequency $f=v/\lambda$, the length l of radiator portion 300 of the conventional antenna is $\lambda/2$, while the length $l_{tot}$ of radiator portion 800 of the coupled radiator segment antenna is $<\lambda/2$.

As stated above, in one embodiment, segments 708, 710 are of a length $l_1=l_2=\lambda/4$. The length of each segment can be varied such that $l_1$ is not necessarily equal to $l_2$, and such that they are not equal to $\lambda/4$. The actual resonant frequency of each radiator is a function of the length of radiator segments 708, 710 the separation distance s between radiator segments 708, 710 and the amount which segments 708, 710 overlap each other.

Note that changing the length of one segment 708 with respect to the other segment 710 can be used to adjust the bandwidth of the antenna. For example, lengthening $l_1$ such that it is slightly greater than $\lambda/4$ and shortening $l_2$ such that it is slightly shorter than $\lambda/4$, can increase the bandwidth of the antenna.

FIG. 8B illustrates the actual helical configuration of a coupled multi-segment quadrifilar helical antenna according to one embodiment of the invention. This illustrates how each radiator is comprised of two segments 708, 710 in one embodiment. Segment 708 extends in a helical fashion from first end 832 of the radiator portion toward second end 834 of the radiator portion. Segment 710 extends in a helical fashion from second end 834 of the radiator portion toward first end 832 of the radiator portion. FIG. 8B further illustrates that a portion of segments 708, 710 overlap such that they are electromagnetically coupled to one another.

Figure 9A:
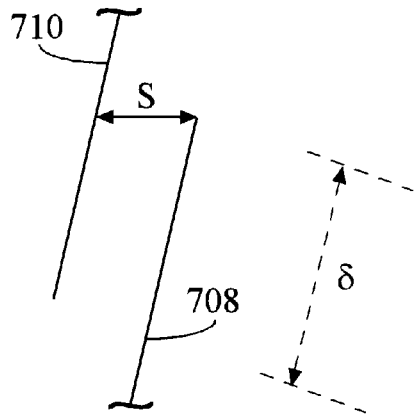
FIG. 9A is a diagram illustrating overlap $\delta$ and spacing s of radiator segments according to one embodiment of the invention.

FIG. 9A is a diagram illustrating the separation s and overlap δ between radiator segments 708, 710. Separation s is chosen such that a sufficient amount of energy is coupled between the radiator segments 708, 710 to allow them to function as a single radiator of an effective electrical length of approximately $\lambda/2$ and integer multiples thereof.

Spacing of radiator segments 708, 710 closer than this optimum spacing results in greater coupling between segments 708, 710. As a result, for a given frequency $f$ the length of segments 708, 710 must increase to enable resonance at the same frequency $f$. This can be illustrated by the extreme case of segments 708, 710 being physically connected (i.e., s=0). In this extreme case, the total length of segments 708, 710 must equal $\lambda/2$ for the antenna to resonate. Note that in this extreme case, the antenna is no longer really coupled according to the usage of the term in this specification, and the resulting configuration is actually that of a conventional helical antenna such as that illustrated in FIG. 3.

Similarly, increasing the amount of overlap δ of segments 708, 710 increases the coupling. Thus as overlap δ increases, the length of segments 708, 710 increases as well.

Figure 9B:
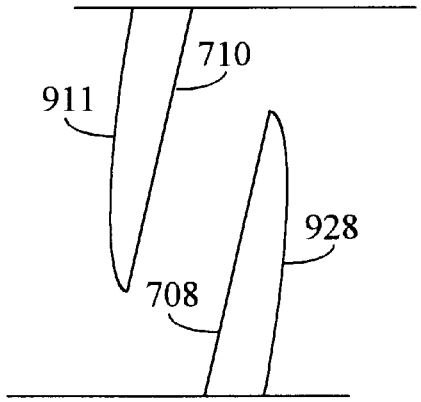
FIG. 9B is a diagram illustrating example current distributions on radiator segments of the coupled multi-segment helical antenna.

To qualitatively understand the optimum overlap and spacing for segments 708, 710, refer to FIG. 9B. FIG. 9B represents a magnitude of the current on each segment 708, 710. Current strength indicators 911, 928 illustrate that each segment ideally resonates at $\lambda/4$, with the maximum signal strength at the outer ends and the minimum at the inner ends.

To optimize antenna configurations for the coupled radiator segment antenna, the inventors utilized modeling software to determine correct segment lengths $l_1$, $l_2$, overlap δ, and spacing s, among other parameters. One such software package is the Antenna Optimizer (AO) software package. AO is based on a method of moments electromagnetic modeling algorithm. AO Antenna Optimizer version 6.35, copyright 1994, was written by and is available from Brian Beezley, of San Diego, Calif.

Note that there are certain advantages obtained by using a coupled configuration as described above with reference to FIGS. 8A and 8B. With both the conventional antenna and the coupled radiator segment antenna, current is concentrated at the ends of the radiators. Pursuant to array factor theory, this can be used to an advantage with the coupled radiator segment antenna in certain applications.

Figure 10A:
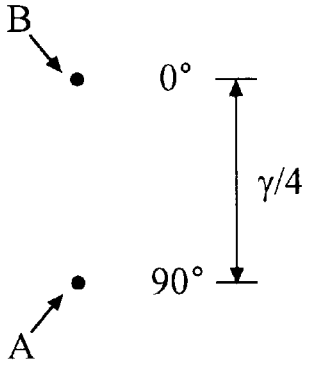
FIG. 10A is a diagram illustrating two point sources radiating signals differing in phase by 90°.
Figure 10B:
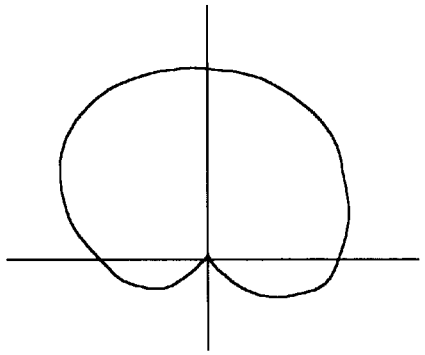
FIG. 10B is a diagram illustrating field patterns for the point sources illustrated in FIG. 10A.

To explain, FIG. 10A is a diagram illustrating two point sources, A, B, where source A is radiating a signal having a magnitude equal to that of the signal of source B but lagging in phase by 90° (the $e^{j\omega t}$ convention is assumed). Where sources A and B are separated by a distance of $\lambda/4$, the signals add in phase in the direction traveling from A to B and add out of phase in the direction from B to A. As a result, very little radiation is emitted in the direction from B to A. A typical representative field pattern shown in FIG. 10B illustrates this point.

Thus, when the sources A and B are oriented such that the direction from A to B points upward, away from the ground, and the direction from B to A points toward the ground, the antenna is optimized for most applications. This is because it is rare that a user desires an antenna that directs signal strength toward the ground. This configuration is especially useful for satellite communications where it is desired that the majority of the signal strength be directed upward, away from the ground.

The point source antenna modeled in FIG. 10A is not readily achievable using conventional half wavelength helical antennas. Consider the antenna radiator portion illustrated in FIG. 3. The concentration of current strength at the ends of radiators 208 roughly approximates a point source. When radiators are twisted into a helical configuration, one end of the 90° radiator is positioned in line with the other end of the 0° radiator. Thus, this approximates two point sources in a line. However, these approximate point sources are separated by approximately $\lambda/2$ as opposed to the desired $\lambda/4$ configuration illustrated in FIG. 10A.

Note, however that the coupled radiator segment antenna according to the invention provides an implementation where the approximated point sources are spaced at a distance closer to $\lambda/4$. Therefore, the coupled radiator segment antenna allows users to capitalize on the directional characteristics of the antenna illustrated in FIG. 10A.

The radiator segments 708, 710 illustrated in FIG. 8 show that segment 708 is very near its associated segment 710, yet each pair of segments 708, 710 are relatively far from the adjacent pair of segments. In one alternative embodiment, each segment 710 is placed equidistant from the segments 708 on either side. This embodiment is illustrated in FIG. 11.

Figure 11:
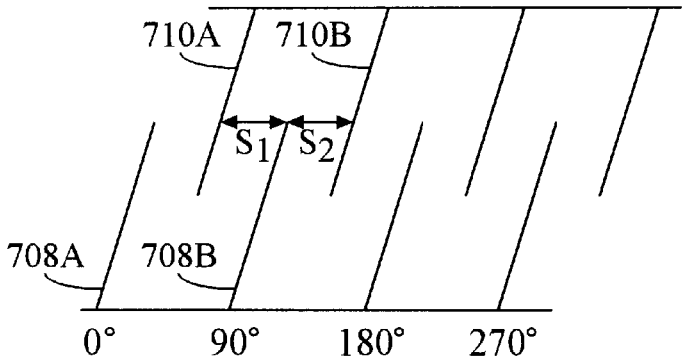
FIG. 11 is a diagram illustrating an embodiment in which each segment is placed equidistant from segments on either side.

Referring now to FIG. 11, each segment is substantially equidistant from each pair of adjacent segments. For example, segment 708B is equidistant from segments 710A, 710B. That is, $s_1=s_2$. Similarly, segment 710A is equidistant from segments 708A, 708B.

This embodiment is counterintuitive in that it appears as if unwanted coupling would exist. In other words, a segment corresponding to one phase would couple not only to the appropriate segment of the same phase, but also to the adjacent segment of the shifted phase. For example, segment 708B, the 90° segment would couple to segment 710A (the 0° segment) and to segment 710B (the 90° segment). Such coupling is not a problem because the radiation from the top segments 710 can be thought of as two separate modes. One mode resulting from coupling to adjacent segments to the left and the other mode from coupling to adjacent segments to the right. However, both of these modes are phased to provide radiation in the same direction. Therefore, this double-coupling is not detrimental to the operation of the coupled multi-segment antenna.

5. Example Implementations

Figure 12:
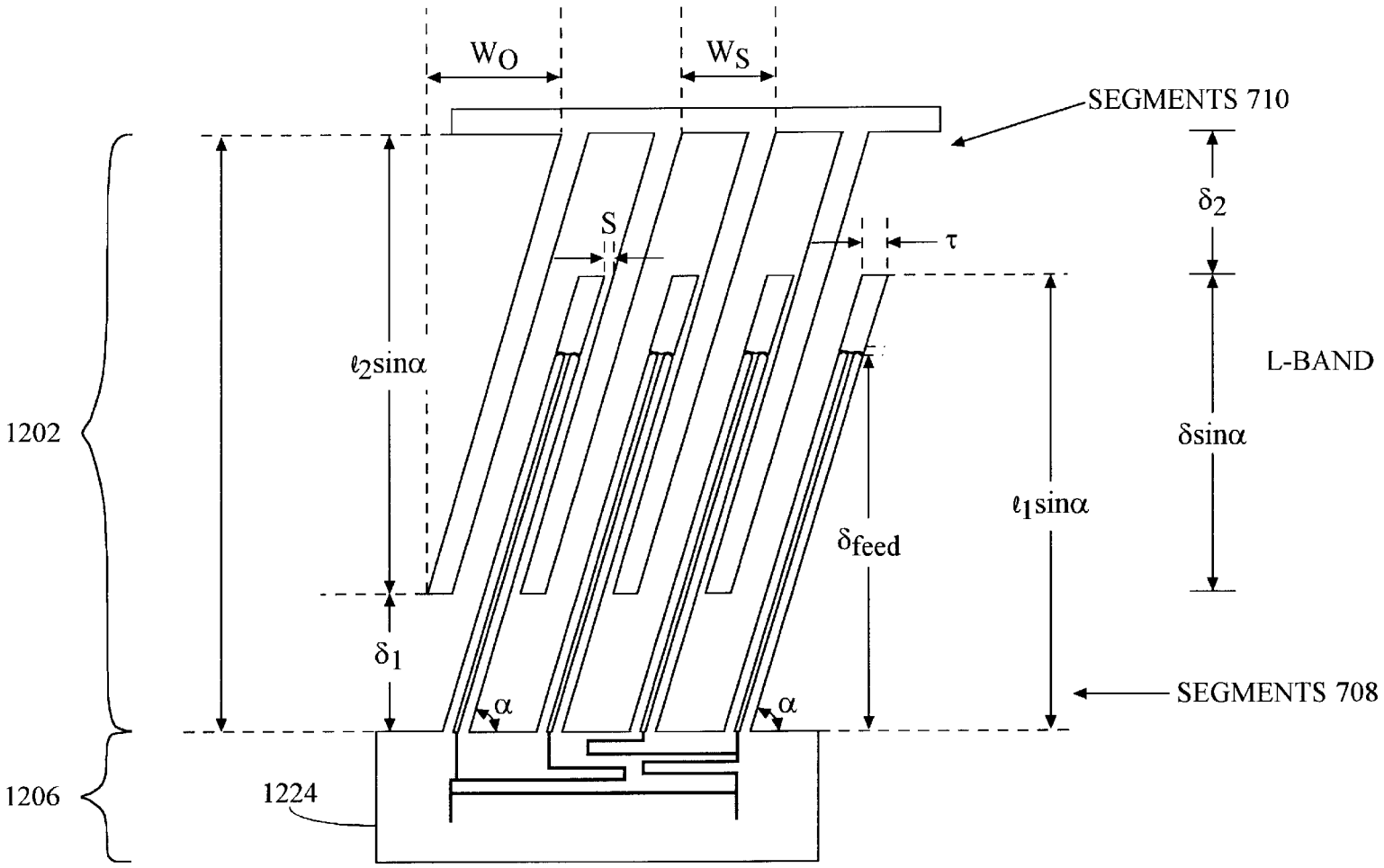
FIG. 12 is a diagram illustrating an example implementation of a coupled multi-segment antenna according to one embodiment of the invention.

FIG. 12 is a diagram illustrating an example implementation of a coupled radiator segment antenna according to one embodiment of the invention. Referring now to FIG. 12, the antenna comprises a radiator portion 1202 and a feed portion 1206. Radiator portion includes segments 708, 710. Dimensions provided in FIG. 12 illustrate the contribution of segments 708, 710 and the amount of overlap $\delta$ to the overall length of radiator portion 1202.

The length of segments in a direction parallel to the axis of the cylinder is illustrated as $l_1\sin\alpha$ for segments 708 and $l_2\sin\alpha$ for segments 710, where $\alpha$ is the inside angle of segments 708, 710.

Segment overlap as illustrated above in FIGS. 8A and 9A, is illustrated by the reference character $\delta$. The amount of overlap in a direction parallel to the axis of the antenna is given by $\delta\sin\alpha$, as illustrated in FIG. 12.

Segments 708, 710 are separated by a spacing s, which can vary as described above. The distance between the end of a segment 708, 710 and the end of radiator portion 1202 is defined as the gap and illustrated by the reference characters $\gamma_1$, $\gamma_2$, respectively. The gaps $\gamma_1$, $\gamma_2$ can, but do not have to be equal to each other. Again, as described above, the length of segments 708 can be varied with respect to that of segments 710.

The amount of offset of a segment 710 from one end to the next is illustrated by the reference character $\omega_0$. The separation between adjacent segments 710 is illustrated by the reference character $\omega_o$, and is determined by the helix diameter.

Feed portion 1206 includes an appropriate feed network to provide the quadrature phase signals to the radiator segments 708. Feed networks are well known to those of ordinary skill in the art and are, thus, not described in detail herein.

In the embodiment illustrated in FIG. 12, segments 708 are fed at a feed point that is positioned along segment 708 a distance from the feed network that is chosen to optimize impedance matching. In the embodiment illustrated in FIG. 12, this distance is illustrated by the reference characters $\delta_{feed}$.

Note that continuous line 1224 illustrates the border for a ground portion on the far surface of the substrate. The ground portion opposite segments 708 on the far surface extends to the feed point. The thin portion of segments 708 is on the near surface. At the feed point, the thickness of segments 708 on the near surface increases.

Dimensions are now provided for an example coupled radiator segment quadrifilar helical antenna suitable for operation in the L-Band at approximately 1.6 GHz. Note that this is an example only and other dimensions are possible for operation in the L-Band. Additionally, other dimensions are possible for operation in other frequency bands as well.

The overall length of radiator portion 1202 in the example L-Band embodiment is 2.30 inches (58.4 mm). In this embodiment, the pitch angle $\alpha$ is 73 degrees. With this angle $\alpha$, the length $l_1\sin\alpha$ of segments 708 for this embodiment is 1.73 inches (43.9 mm). In the illustrated embodiment, the length of segments 710 is equal to the length of segments 708.

In one example embodiment, segment 710 is positioned substantially equidistant from its adjacent pair of segments 708. In one implementation of the embodiment where segments 710 are equidistant from adjacent segments 708, the spacing $s_1=s_2=0.086$ inches. Other spacings are possible including, for example, the spacing s of segments 710 at 0.070 inches (1.8 mm) from an adjacent segment 708.

The width $\tau$ of radiator segments 708, 710 is 0.11 inches (2.8 mm) in this embodiment. Other widths are possible.

The example L-Band embodiment features a symmetric gap $\gamma_1=\gamma_2=0.57$ inches (14.5 mm). Where the gap $\gamma$ is symmetric for both ends of the radiator portion 1202 (i.e., where $\gamma_1=\gamma_2$), radiators 708, 710 have an overlap $\delta\sin\alpha$ of 1.16 inches(29.5 mm) (1.73 inches-0.57 inches).

The segment offset $\omega_0$ is 0.53 inches and the segment separation $\omega_s$ is 0.393 inches (10.0 mm). The diameter of the antenna is $4\omega_s/\pi$.

In one embodiment, this is chosen such that the distance $\delta_{feed}$ from the feed point to the feed network is $\delta_{feed}=1.57$ inches (39.9 mm). Other feed points can be chosen to optimize impedance matching.

Note that the example embodiment described above is designed for use in conjunction with a 0.032 inch thick polycarbonate radome enclosing the helical antenna and contacting the radiator portion. It will become apparent to a person skilled in the art how a radome or other structure affects the wavelength of a desired frequency.

Note that in the example embodiments just described, the overall length of the L-Band antenna radiator portion is reduced from that of a conventional half-wavelength L-Band antenna. For a conventional half wavelength L-Band antenna, the length of the radiator portion is approximately 3.2 inches (i.e., $\lambda/2(\sin\alpha)$), where $\alpha$ is the inside angle of segments 708, 710 with respect to the horizontal), or (81.3 mm). For the example embodiments described above, the overall length of the radiator portion 1202 is 2.3 inches (58.42 mm). This represents a substantial savings in size over the conventional antenna.

Figure 13:
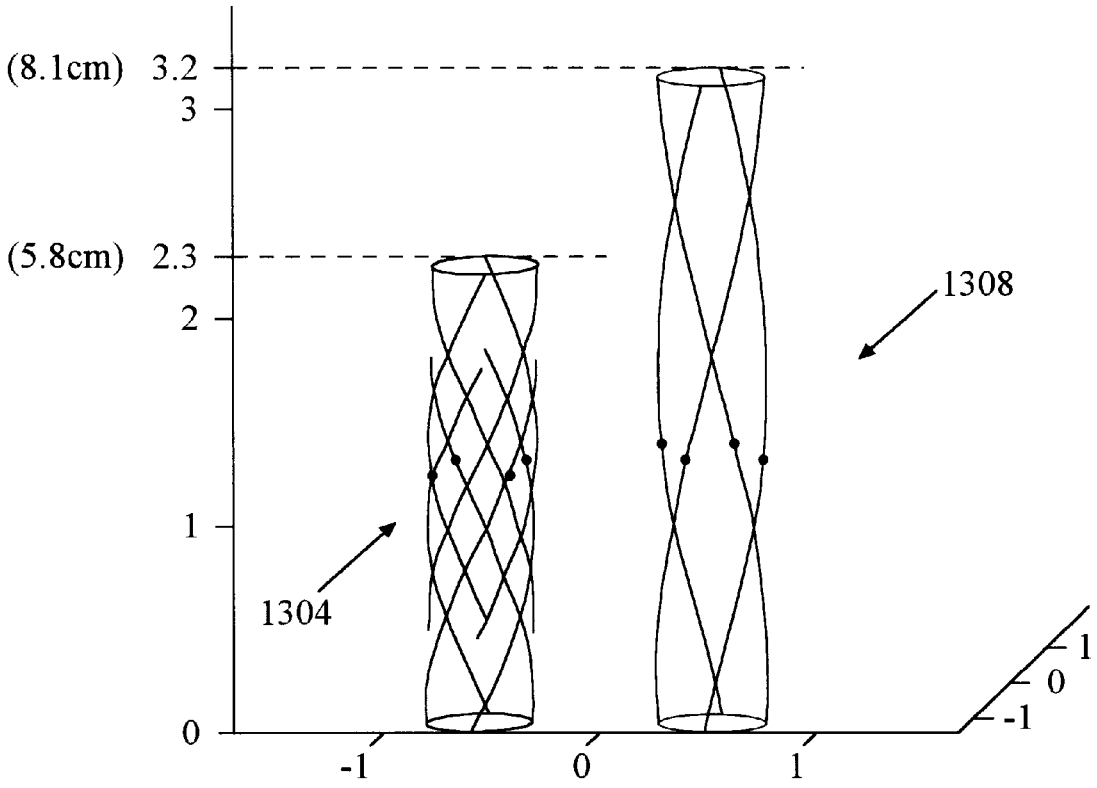
FIG. 13 is a diagram illustrating a comparison between radiator portions of a conventional quadrifilar helical antenna and a coupled multi-segment quadrifilar helical antenna.

FIG. 13 is a diagram illustrating a side-by-side comparison of a half-wavelength L-Band coupled multi-segment antenna radiator portion 1304 and a conventional L-Band quadrifilar helical antenna 1308. As is illustrated by FIG. 13, the coupled radiator segment antenna radiator portion 1304 is significantly shorter than conventional quadrifilar helical antenna 1308.

An example embodiment for S-Band at approximately 2.49 GHz is now described. The overall length of radiator portion 1202 in the example S-Band embodiment is 1.50 inches (38.1 mm). The pitch angle, $\alpha$, in this embodiment, is 65 degrees. The length $l_1 \sin\alpha$ of segments 708 for this embodiment is 0.95 inches (24.1 mm). The length of segments 710 is equal to the lengths of segments 708. The preferred embodiment is a spacing that positions segments 710 equidistant from this adjacent pair of segments 708 ($s_1=s_2=0.086$ inches). The width $\tau$ of radiator segments 708, 710 is 0.11 inches (2.8 mm). The feed point $\delta_{feed}$ for 50 $\Omega$ impedance-matching is 0.60 inches.

The example S-Band embodiment features a symmetric gap (i.e., $\gamma_1=\gamma_2=0.55$ inches) for both ends of the radiator portion 1202, the radiators 708, 710 have an overlap $\delta\sin\alpha$ of 0.40 inches (10.2 mm) (0.95 inches−0.55 inches).

The segment offset $\omega_0$ is 0.44 inches (11.2 mm) and the segment separation $\omega_s$ is 0.393 inches (10.0 mm). The diameter of the antenna is $4\omega_s/\pi$.

Note that the example embodiment just described is designed with a 0.032 inch thick polycarbonate radome enclosing the helical antenna (and contacting the radiator portion).

In these embodiments, the overall length of the S-Band antenna is reduced from that of a conventional half-wavelength S-Band antenna. For a conventional half wavelength S-Band antenna, the length of the radiator portion is approximately 2.0 inches ($\lambda/2(\sin\alpha)$), where $\alpha$ is the inside angle of segments with respect to the horizontal), or (50.8 mm). In the embodiment just described, the overall length of radiator portion 1202 is 1.5 inches.

Figure 14A:
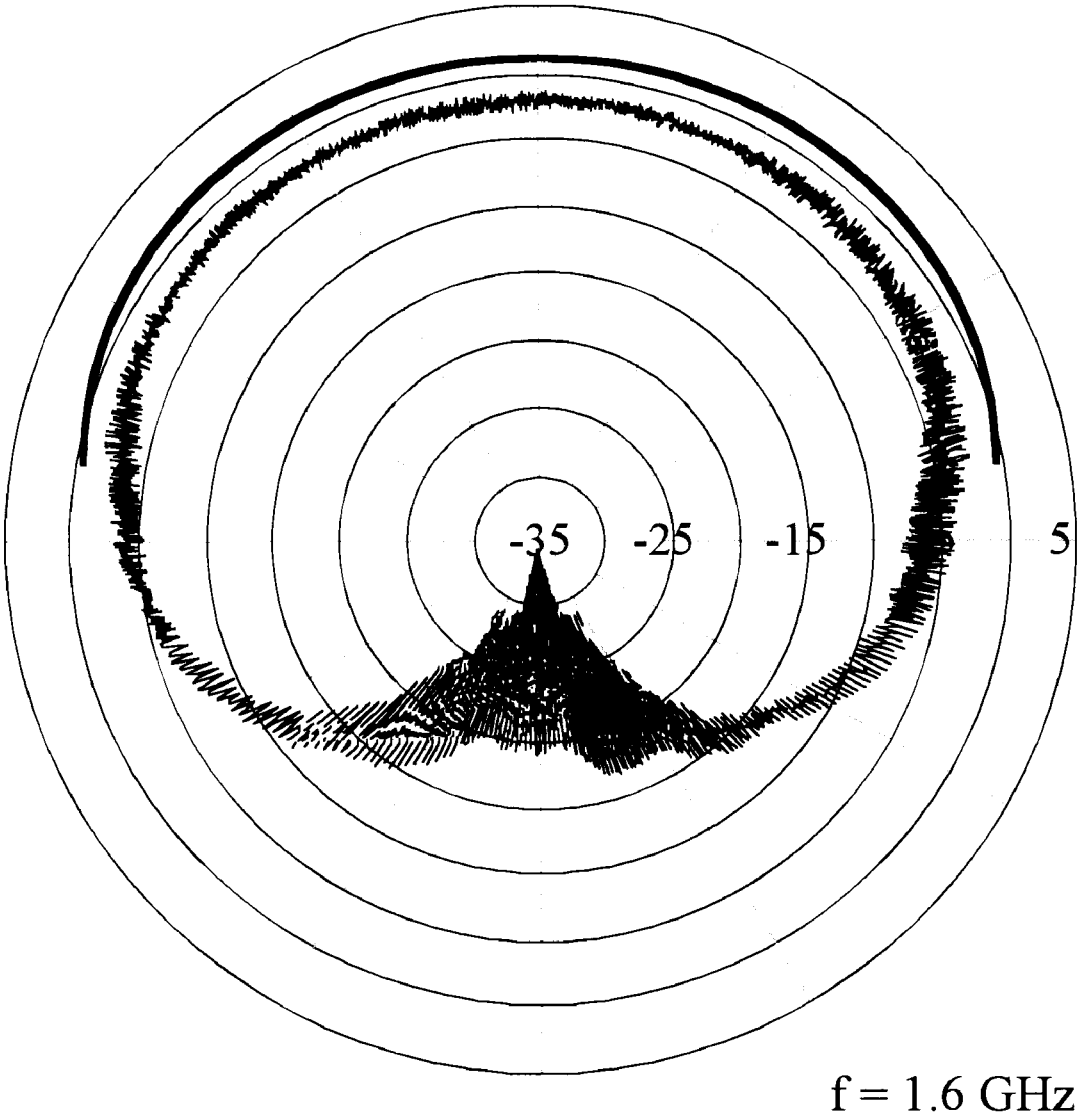
FIG. 14A is a diagram illustrating a radiation pattern of an example implementation of a coupled multi-segment quadrifilar helical antenna operating in the L-Band.
Figure 14B:
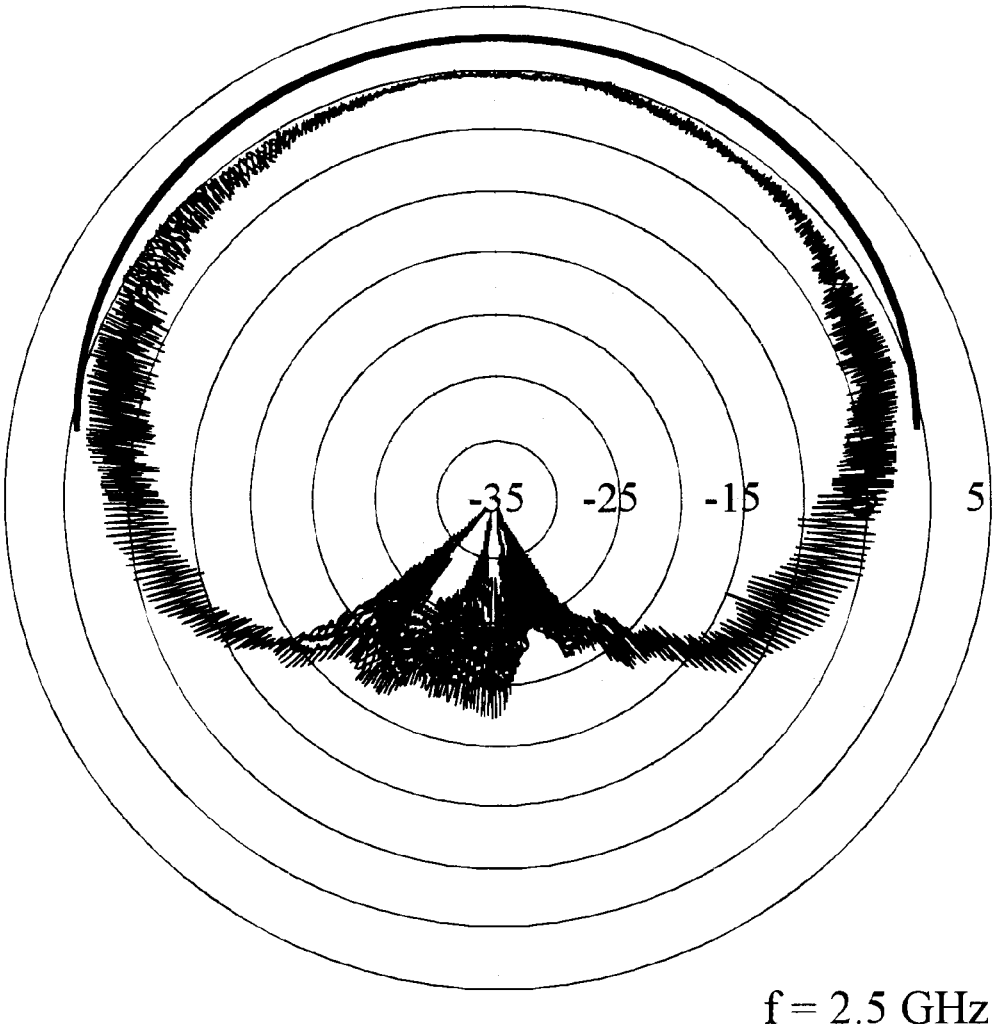
FIG. 14B is a diagram illustrating a radiation pattern of an example implementation of a coupled multi-segment quadrifilar helical antenna operating in the S-Band.

FIG. 14A is a diagram illustrating a radiation pattern of an example implementation of a coupled multi-segment quadrifilar helical antenna operating in the L-Band. FIG. 14B is a diagram illustrating a radiation pattern of an example implementation of a coupled multi-segment quadrifilar helical antenna operating at S-Band. As these patterns illustrate, the antennas provide good omni-directional characteristics in the upper half-plane and exhibit good circular polarization.

In the strip embodiments discussed above, the radiator segments 708, 710, 712 are described as all being provided on the same surface of the substrate. In alternative embodiments, the segments need not all be positioned on the same surface of the substrate. For example, in one embodiment, segments at the first end (i.e., segments 708) are positioned on one surface of the substrate and segments at the second end (i.e., segments 710) are positioned on the opposite surface. This and other embodiments not requiring all of segments 708, 710, 712 to be on the same surface are possible because the segments do not need to be strictly edge-wise aligned for the electromagnetic energy to couple. Small offsets on the order of the thickness of the substrate do not adversely affect coupling. These embodiments allowing selective placement of segments 708, 710, 712 can be used to provide certain components or segments on the outside of the antenna to allow access to those components for such purposes as tuning, or making connections to the components while providing other components inside the antenna.

In some applications, it is desirable to have an antenna that operates at two frequencies. One example of such an application is a communication system operating at one frequency for transmit and a second frequency for receive. One conventional technique for achieving dual-band performance is to stack two single-band quadrifilar helical antennas end-to-end to form a single long cylinder. For example, a system designer may stack an L-Band and an S-Band antenna to achieve operational characteristics at both L and S bands. Such stacking, however, increases the overall length of the antenna. Reductions in size obtained by using coupled radiator segment antennas can provide dramatic reductions in the overall length of a stacked dual-band antenna.

One additional advantage of the segmented radiator helical antenna is that it is very easy to tune the antenna after it has already been manufactured. The antenna can be simply tuned by trimming segments 708, 710. Note that, if desired, this can be done without changing the overall length of the antenna.

Note that the embodiments of the coupled radiator segment antenna described above are presented in terms of a half-wavelength antenna resonating at a wavelength equal to an integer multiple of $\lambda/2$. After reading this document, it will become apparent to a person of ordinary skill in the art how to implement the invention using an antenna resonating at a wavelength equal to an odd integer multiple of $\lambda/4$ by omitting the shorting ring at the far end of the radiators.

3. Conclusion

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What we claim is:

1. A helical antenna comprising a radiator portion having a helically wound radiator extending from a first end of the radiator portion to a second end of the radiator portion, said radiator comprising:

a first radiator segment of a length substantially equal to an odd multiple of a quarter wavelength extending in a helical fashion from the first end of the radiator portion toward the second end of the radiator portion, wherein said first radiator segment is a driven radiator segment, configured for connection to a feed; and a second radiator segment of a length substantially equal to an odd multiple of a quarter wavelength extending in a helical fashion from the second end of the radiator portion toward the first end of the radiator portion and partially overlapping said first radiator segment, wherein said second radiator segment is a parasitic radiator;

wherein said first radiator segment is in proximity with said second radiator segment in the area of overlap such that said first and second radiator segments are electromagnetically coupled to one another such that said first and second radiator segments resonate at the same selected frequency.

2. The helical antenna of claim 1, wherein said first and second radiator segments are comprised of strip segments deposited on a dielectric substrate, wherein said dielectric substrate is shaped such that the radiator segments are wrapped in a helical fashion.

3. The helical antenna of claim 2, wherein said dielectric substrate is formed into a cylindrical shape or a conical shape.

4. The helical antenna of claim 1, wherein said first and second radiator segments are wire segments.

5. The helical antenna of claim 1, wherein said first radiator segment is equal in length to said second radiator segment.

6. The helical antenna of claim 1, wherein each of said first and second radiator segments is $\lambda/4$ in length, where $\lambda$ is the wavelength of a resonant frequency of the antenna.

7. The helical antenna of claim 1 comprising four radiators and further comprising a feed network for providing a quadrature phase signal to said four radiators.

8. The helical antenna of claim 1, further comprising a feed point for said first radiator segment that is spaced along said first radiator segment from said first end a distance that substantially matches the impedance of the radiator segments to a feed network.

9. The helical antenna of claim 1 further comprising one or more intermediate radiator segments positioned between said first and second radiator segments.

10. The helical antenna of claim 1, wherein a portion of said first radiator segment is in close proximity with a portion of said second radiator segment.

11. The helical antenna of claim 1, wherein said first radiator segment is connected to a feed network at said first end and said second radiator segment has an open termination at said second end.

12. The helical antenna of claim 1, wherein said second segment axially extends beyond said first segment.

13. The helical antenna of claim 1, wherein said partial overlap is defined by $\delta=l_1+l_2-l_{tot}$, where $l_1$ and $l_2$ are the lengths of said first and second radiator segments, respectively, and $l_{tot}$ is the overall length of the radiator portion.

14. A helical antenna comprising a radiator portion having a plurality of helically wound multi-segment radiators extending from a first end of the radiator portion to a second end of the radiator portion, said multi-segment radiators each comprising at least first and second substantially parallel and overlapping segments, each of said segments being of a length substantially equal to an odd multiple of a quarter wavelength, wherein said first segment is physically separate from but electromagnetically coupled to said second segment, and wherein said first and second segments resonate at the same selected frequency.

15. The helical antenna of claim 14, wherein said first and second segments comprise strip segments deposited on a dielectric substrate.

16. The helical antenna of claim 14, wherein said first segment is equal in length to said second segment.

17. The helical antenna of claim 14, wherein said first and second radiator segments comprise wire segments.

18. The helical antenna of claim 14, wherein the effective combined length of said first and second segments is approximately an integer multiple of $\lambda/2$, where $\lambda$ is the wavelength of a resonant frequency of the antenna.

19. The helical antenna of claim 14, comprising four radiators and further comprising a feed network for providing a quadrature phase signal to said four radiators.

20. The helical antenna of claim 14, further comprising a feed point for each said radiator, wherein said feed point is positioned at a distance from said first end along said first segment, wherein said distance is chosen to match the impedance of the radiators to a feed network.

21. The helical antenna of claim 14, wherein a portion of said first segment is in close proximity with a portion of said second segment.

22. The helical antenna of claim 14, wherein said radiator portion is a first radiator portion, and further comprising a second radiator portion having a plurality of helically wound segmented radiators extending from a first end of said second radiator portion to a second end of said second radiator portion, said segmented radiators each comprising first and second segments, wherein said first segment is physically separate from but electromagnetically coupled to said second segment.

23. The helical antenna of claim 22, wherein said first radiator portion is stacked coaxially with said second radiator portion.

24. The helical antenna of claim 14, wherein said radiators are helically wound into a cylindrical or conical shape.

25. A helical antenna comprising a radiator portion having a plurality of helically wound multi-segment radiators extending from a first end of the radiator portion to a second end of the radiator portion, said multi-segment radiators each comprising an elongated driven segment extending from said first end and a plurality of elongated parasitic segments, wherein each segment of said parasitic segments is substantially parallel to and overlaps an adjacent segment and said plurality of parasitic segments axially extend substantially parallel to and beyond said driven segment, wherein each of said driven segment and a last parasitic segment extending from said second end is of a length substantially equal to an odd multiple of a quarter wavelength and each of said parasitic segments intermediate said driven and last parasitic segments is of a length substantially equal to an integer multiple of a half wavelength, and wherein said driven and parasitic segments resonate at the same selected frequency.

26. A helical antenna comprising a radiator portion having a plurality of helically wound multi-segment radiators extending from a first end of the radiator portion to a second end of the radiator portion, said multi-segment radiators each comprising at least first and second segments, wherein each of said first and second segments has a length substantially equal to an odd multiple of a quarter wavelength and said first segment is physically separate from but electromagnetically coupled to said second segment, wherein said radiators further comprise one or more intermediate radiator segments positioned between said first and second segments, and wherein each of said first, second, and intermediate radiator segments resonate at the same selected frequency.

27. The helical antenna of claim 26, wherein said second radiator segments have an open termination at said second end.

28. The helical antenna of claim 26, further comprising means for shorting said plurality of second radiator segments at said second end.

29. A helical antenna comprising a radiator portion having a helically wound radiator extending from a first end of the radiator portion to a second end of the radiator portion, said radiator comprising:

a plurality of first radiator segments of a length substantially equal to an odd multiple of a quarter wavelength extending in a helical fashion from the first end of the radiator portion toward the second end of the radiator portion, wherein said first radiator segments are driven radiator segments, configured for connection to a feed;

a plurality of second radiator segments of a length substantially equal to an odd multiple of a quarter wavelength extending in a helical fashion from the second end of the radiator portion toward the first end of the radiator portion and partially overlapping said first radiator segments, wherein said second radiator segments are parasitic radiators; and means for shorting said plurality of second radiator segments;

wherein said first radiator segments are in proximity with said second radiator segments in the area of overlap such that said first and second radiator segments are electromagnetically coupled to one another such that said first and second radiator segments resonate at the same selected frequency.

* * * * *